US011530676B2

(12) United States Patent
Mashimo

(10) Patent No.: US 11,530,676 B2
(45) Date of Patent: Dec. 20, 2022

(54) POWER SUPPLY SYSTEM FOR WATERCRAFT

(71) Applicant: YAMAHA HATSUDOKI KABUSHIKI KAISHA, Iwata (JP)

(72) Inventor: Masaaki Mashimo, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 17/568,883

(22) Filed: Jan. 5, 2022

(65) Prior Publication Data

US 2022/0243693 A1 Aug. 4, 2022

(30) Foreign Application Priority Data

Feb. 1, 2021 (JP) ..... JP2021-014567

(51) Int. Cl.
*F02N 11/08* (2006.01)
*B63H 21/14* (2006.01)

(52) U.S. Cl.
CPC ..... *F02N 11/0866* (2013.01); *B63H 21/14* (2013.01); *F02N 11/087* (2013.01); *F02N 2011/0874* (2013.01)

(58) Field of Classification Search
CPC ..... B63H 21/14; B63H 23/10; B63H 23/12; B63H 23/14; B63H 23/16; B63H 23/18; B63H 23/20; B63H 2020/003; F02N 11/08; F02N 11/0866; F02N 11/087; F02N 11/0874
USPC ..... 123/8
See application file for complete search history.

(56) References Cited

U.S. PATENT DOCUMENTS 4,935,689 A * 6/1990 Fujikawa ..... F02B 73/00 60/714
5,233,282 A * 8/1993 Iwashita ..... B60L 58/21 320/128
5,685,802 A * 11/1997 Kanno ..... F02B 75/20 290/40 C
5,977,652 A * 11/1999 Frey ..... H02J 7/1423 307/64
6,525,508 B1 * 2/2003 Kanno ..... H02J 7/1423 320/103
6,987,376 B2 * 1/2006 Kanno ..... H02J 7/1476 320/132
9,598,163 B1 * 3/2017 Gable ..... B63H 20/12
2015/0034001 A1 * 2/2015 Clarke ..... B63H 25/42 114/144 R
2021/0300516 A1 * 9/2021 Hayashi ..... B63H 21/22

FOREIGN PATENT DOCUMENTS

JP 2010-241207 A 10/2010

* cited by examiner

*Primary Examiner* — Erick R Solis
(74) *Attorney, Agent, or Firm* — Keating and Bennett, LLP

(57) ABSTRACT

A power supply system for a watercraft includes a first battery, a second battery, and a battery management device. The battery management device connects the first battery to a first engine to supply an electric power from the first battery to start the first engine. The battery management device connects the second battery to a second engine and a third engine to supply an electric power from the second battery to start the second engine and the third engine.

18 Claims, 3 Drawing Sheets

POWER SUPPLY SYSTEM FOR WATERCRAFT

CROSS REFERENCE TO RELATED APPLICATIONS

This application claims the benefit of priority to Japanese Patent Application No. 2021-014567 filed on Feb. 1, 2021. The entire contents of this application are hereby incorporated herein by reference.

BACKGROUND OF THE INVENTION

1. Field of the Invention

The present invention relates to a power supply system for a watercraft.

2. Description of the Related Art

A battery for starting a drive unit such as an engine or an electric motor is connected to a marine propulsion device. The marine propulsion device starts the drive unit by the electric power supplied from the battery. A watercraft may be equipped with a plurality of marine propulsion devices. In that case, a plurality of batteries are mounted on the watercraft. The plurality of batteries are connected to the plurality of marine propulsion devices, respectively. For example, the watercraft disclosed in Japanese Patent Application Laid-Open No. 2010-241207 includes three marine propulsion devices and three batteries. A first battery is connected to a first one of the three marine propulsion devices, a second battery is connected to a second one of the three marine propulsion devices, and a third battery is connected to a third one of the three marine propulsion devices.

As described above, when the plurality of batteries are connected to the plurality of marine propulsion devices, respectively, if the number of marine propulsion devices increases, the number of batteries mounted on the watercraft increases proportionally. Therefore, in the watercraft, the space for mounting the batteries is increased.

SUMMARY OF THE INVENTION

Preferred embodiments of the present invention reduce the number of batteries while maintaining good startability of the drives in the marine propulsion devices.

A system according to a first preferred embodiment of the present invention is a power supply system for a watercraft. The watercraft includes a first marine propulsion device, a second marine propulsion device, and a third marine propulsion device. The first marine propulsion device includes a first engine. The second marine propulsion device includes a second engine. The third marine propulsion device includes a third engine. The power supply system includes a first battery, a second battery, and a battery management device. The battery management device connects the first battery to the first engine and supplies an electric power from the first battery to start the first engine. The battery management device connects the second battery to the second engine and the third engine, and supplies an electric power from the second battery to start the second engine and the third engine.

A system according to a second preferred embodiment of the present invention is a power supply system for a watercraft. The watercraft includes a first marine propulsion device, a second marine propulsion device, and a third marine propulsion device. The first marine propulsion device includes a first drive. The second marine propulsion device includes a second drive. The third marine propulsion device includes a third drive. The power supply system includes a first battery, a second battery, and a battery management device. The battery management device connects the first battery to the first drive, and supplies an electric power from the first battery to start the first drive. The battery management device connects the second battery to the second drive and the third drive, and supplies an electric power from the second battery to start the second drive and the third drive.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
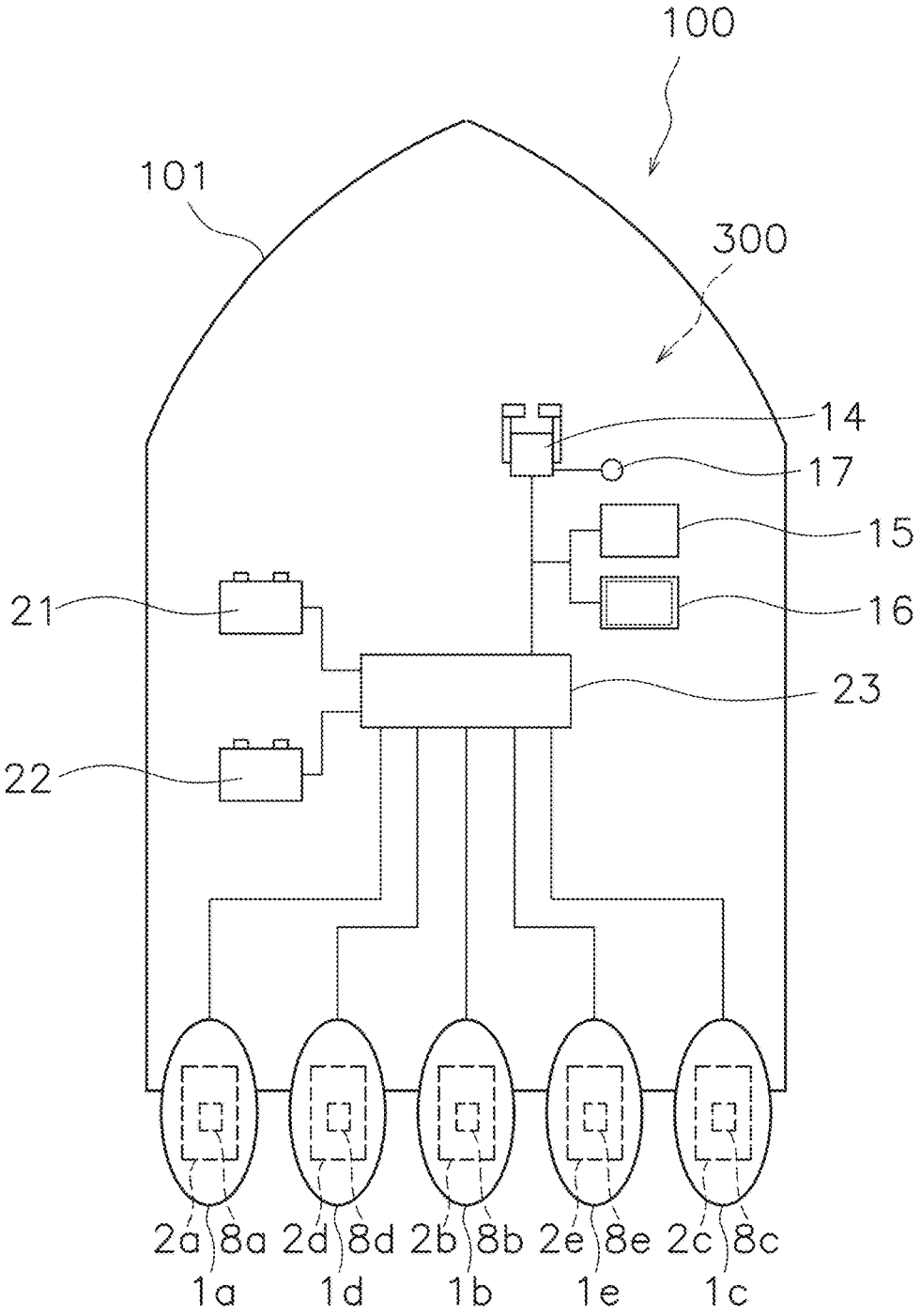
FIG. 1 is a schematic view showing a watercraft equipped with a power supply system according to a preferred embodiment of the present invention.

Hereinafter, preferred embodiments of the present invention will be described with reference to the drawings. FIG. 1 is a schematic view showing a watercraft 100 equipped with a power supply system 300 according to a preferred embodiment of the present invention. The watercraft 100 includes a hull 101 and a plurality of marine propulsion devices 1*a* to 1*e*. In the present preferred embodiment, the marine propulsion devices 1*a* to 1*e* are outboard motors. The marine propulsion devices 1*a* to 1*e* are attached to the stern of the hull 101. The marine propulsion devices 1*a* to 1*e* generate thrusts to propel the watercraft 100. The plurality of marine propulsion devices 1*a* to 1*e* include a first marine propulsion device 1*a*, a second marine propulsion device 1*b*, a third marine propulsion device 1*c*, a fourth marine propulsion device 1*d*, and a fifth marine propulsion device 1*e*.

The first marine propulsion device 1*a* is located on the port side of the watercraft 100. The third marine propulsion device 1*c* is located on the starboard side of the watercraft 100. The second marine propulsion device 1*b* is located at the center of the watercraft between the first marine propulsion device 1*a* and the third marine propulsion device 1*c*. The fourth marine propulsion device 1*d* is located between the first marine propulsion device 1*a* and the second marine propulsion device 1*b*. The fifth marine propulsion device 1*e* is located between the third marine propulsion device 1*c* and the second marine propulsion device 1*b*.

Figure 2:
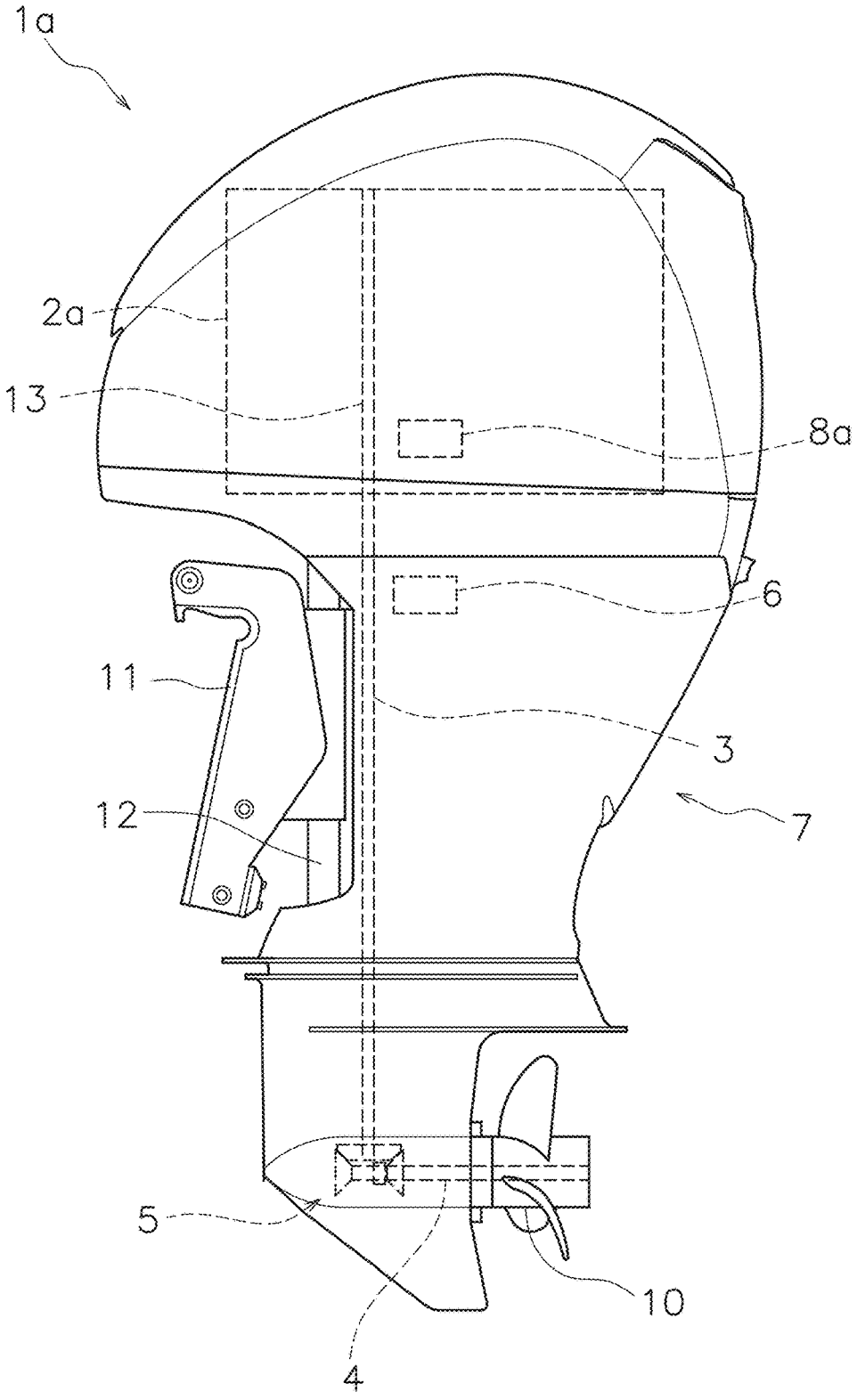
FIG. 2 is a side view of a marine propulsion device.

FIG. 2 is a side view of the first marine propulsion device 1*a*. The first marine propulsion device 1*a* is attached to the hull 101 via a bracket 11. The bracket 11 rotatably supports the first marine propulsion device 1*a* around a steering shaft 12. The steering shaft 12 extends in the vertical direction of the first marine propulsion device 1*a*.

The first marine propulsion device 1*a* includes a first drive unit 2*a*, a drive shaft 3, a propeller shaft 4, a shift mechanism 5, a first generator 6, and a housing 7. The first drive unit 2*a* generates a driving force to rotate the drive shaft 3. In the present preferred embodiment, the first drive unit 2*a* is an internal combustion engine, for example. The first drive unit 2*a* includes a crankshaft 13. The crankshaft 13 extends in the vertical direction of the first marine propulsion device 1*a*. The drive shaft 3 is connected to the crankshaft 13. The drive shaft 3 extends in the vertical direction of the first marine propulsion device 1*a*.

The first drive unit 2*a* includes a first starter motor 8*a*. The first starter motor 8*a* is connected to the crankshaft 13. Alternatively, the first starter motor 8*a* may be connected to the drive shaft 3. The first starter motor 8*a* starts the first drive unit 2*a*. The first generator 6 generates an electric power by being driven by the first drive unit 2*a*. The first generator 6 is connected to the drive shaft 3 via, for example, a gear mechanism. Alternatively, the first generator 6 may be connected to the crankshaft 13.

The propeller shaft 4 extends in the front-rear direction of the first marine propulsion device 1*a*. The propeller shaft 4 is connected to the drive shaft 3 via the shift mechanism 5. A propeller 10 is attached to the propeller shaft 4. The shift mechanism 5 includes, for example, a gear and a clutch. The shift mechanism 5 is switched between a forward state, a reverse state, and a neutral state. In the forward state, the shift mechanism 5 transmits rotation from the drive shaft 3 to the propeller shaft 4 in the direction in which the watercraft 100 moves forward. In the reverse state, the shift mechanism 5 transmits rotation from the drive shaft 3 to the propeller shaft 4 in the direction in which the watercraft 100 moves backward. The housing 7 houses the first drive unit 2*a*, the drive shaft 3, the propeller shaft 4, and the shift mechanism 5.

The second to fifth marine propulsion devices 1*b* to 1*e* each have the same configuration as the first marine propulsion device 1*a*. As illustrated in FIG. 1, the second marine propulsion device 1*b* includes a second drive unit 2*b*. The second drive unit 2*b* includes a second starter motor 8*b*. The third marine propulsion device 1*c* includes a third drive unit 2*c*. The third drive unit 2*c* includes a third starter motor 8*c*. The fourth marine propulsion device 1*d* includes a fourth drive unit 2*d*. The fourth drive unit 2*d* includes a fourth starter motor 8*d*. The fifth marine propulsion device 1*e* includes a fifth drive unit 2*e*. The fifth drive unit includes a fifth starter motor 8*e*.

The power supply system 300 is mounted on the watercraft 100. The power supply system 300 controls the electric power supplied to the first to fifth marine propulsion devices 1*a* to 1*e*. The power supply system 300 includes a first battery 21, a second battery 22, and a battery management device 23. The first to fifth marine propulsion devices 1*a* to 1*e* are connected to the first battery 21 and the second battery 22 via the battery management device 23.

Figure 3:
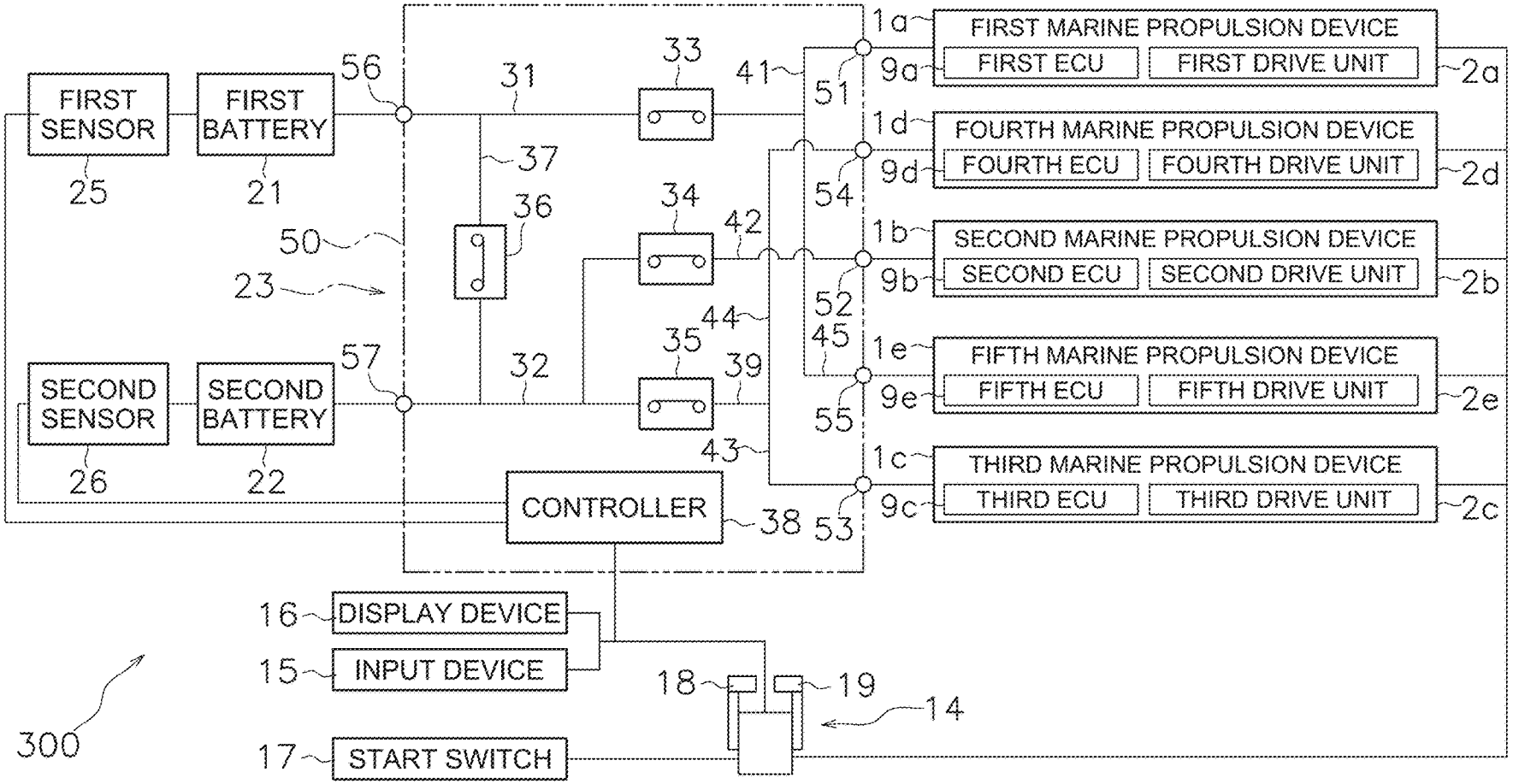
FIG. 3 is a schematic diagram showing a configuration of the power supply system.

FIG. 3 is a schematic view showing a configuration of a control system of the first to fifth marine propulsion devices 1*a* to 1*e* and the power supply system 300. As illustrated in FIG. 3, the first to fifth marine propulsion devices 1*a* to 1*e* include first to fifth ECUs (Electronic Control Units) 9*a* to 9*e*, respectively. The first to fifth ECUs 9*a* to 9*e* include a computer including a processor and a memory, respectively. The first ECU 9*a* controls the first drive unit 2*a*. The second ECU 9*b* controls the second drive unit 2*b*. The third ECU 9*c* controls the third drive unit 2*c*. The fourth ECU 9*d* controls the fourth drive unit 2*d*. The fifth ECU 9*e* controls the fifth drive unit 2*e*.

The watercraft 100 includes a remote controller 14, an input device 15, a display device 16, and a start switch 17. The remote controller 14, the input device 15, the display device 16, and the start switch 17 are located in the cockpit of the watercraft 100. The remote controller 14 is connected to the first to fifth ECUs 9*a* to 9*e*. The remote controller 14 includes a first throttle lever 18 and a second throttle lever 19. The first throttle lever 18 and the second throttle lever 19 are operable by an operator. The remote controller 14 transmits a throttle command to the first to fifth ECUs 9*a* to 9*e* in response to an operation of the first throttle lever 18 and the second throttle lever 19. The first to fifth ECUs 9*a* to 9*e* control the outputs of the first to fifth drive units 2*a* to 2*e* in response to the throttle command.

The input device 15 is operable by the operator. The input device 15 outputs a signal indicating an operation input to the input device 15. The display device 16 displays an image corresponding to a signal input to the display device 16. The display device 16 is, for example, a display such as a liquid crystal display or an organic EL display. The input device 15 includes, for example, a switch. Alternatively, the input device 15 may be a touch screen integrated with the display device 16.

The start switch 17 is operable by the operator. When the start switch 17 is operated, an ON signal is output from the start switch 17. When the start switch 17 is operated, the first to fifth ECUs 9*a* to 9*e* start the first to fifth drive units 2*a* to 2*e*. The display device 16 and the remote controller 14 are connected to the battery management device 23. The start switch 17 is connected to the battery management device 23 via the remote controller 14.

The battery management device 23 includes a first electric circuit 31, a second electric circuit 32, first to fourth switches 33 to 36, a connection circuit 37, and a controller 38. The first electric circuit 31 connects the first battery 21 to the first marine propulsion device 1*a* and the fifth marine propulsion device 1*e*. Specifically, the first electric circuit 31 is branched into a first circuit 41 and a fifth circuit 45. The first circuit 41 is connected to the first marine propulsion device 1*a*. The fifth circuit 45 is connected to the fifth marine propulsion device 1*e*. The first battery 21 supplies electric power to the first drive unit 2*a* and the fifth drive unit 2*e*. The electric power from the first battery 21 drives the first starter motor 8*a* of the first drive unit 2*a* and the fifth starter motor 8*e* of the fifth drive unit 2*e*.

The second electric circuit 32 connects the second battery 22 to the second marine propulsion device 1*b*, the third marine propulsion device 1*c*, and the fourth marine propulsion device 1*d*. Specifically, the second electric circuit 32 is branched into a second circuit 42 and a third electric circuit 39. The second circuit 42 is connected to the second marine propulsion device 1*b*. The third electric circuit 39 is branched into a third circuit 43 and a fourth circuit 44. The third circuit 43 is connected to the third marine propulsion device 1*c*. The fourth circuit 44 is connected to the fourth marine propulsion device 1*d*. The second battery 22 supplies electric power to the second drive unit 2*b*, the third drive unit 2*c*, and the fourth drive unit 2*d*. The electric power from the second battery 22 drives the second starter motor 8*b* of the second drive unit 2*b*, the third starter motor 8*c* of the third drive unit 2*c*, and the fourth starter motor 8*d* of the fourth drive unit 2*d*.

The first to fourth switches 33 to 36 are, for example, solenoid relays. The first to fourth switches 33 to 36 are connected to the controller 38. The first to fourth switches 33 to 36 are switched between a closed state and an open state according to a signal from the controller 38, respectively. The first switch 33 is provided in the first electric circuit 31. The first switch 33 switches between an electrical connection and a disconnection between the first drive unit 2*a* and the first battery 21. Further, the first switch 33 switches between an electrical connection and a disconnection between the fifth drive unit 2*e* and the first battery 21.

The second switch 34 is provided in the second circuit 42. The second switch 34 switches between an electrical connection and a disconnection between the second drive unit 2*b* and the second battery 22. The third switch 35 is provided in the third electric circuit 39. The third switch 35 switches between an electrical connection and a disconnection between the third drive unit 2*c* and the second battery 22. Further, the third switch 35 switches between an electrical connection and a disconnection between the fourth drive unit 2*d* and the second battery 22. The fourth switch 36 is provided in the connection circuit 37. The connection circuit 37 connects the first electric circuit 31 and the second electric circuit 32. The fourth switch 36 switches between an electrical connection and a disconnection between the first electric circuit 31 and the second electric circuit 32.

The battery management device 23 includes a housing 50, first to fifth connection ports 51 to 55, a first battery connection port 56, and a second battery connection port 57. The first to fifth connection ports 51 to 55, the first battery connection port 56, and the second battery connection port 57 are provided on the housing 50. The first connection port 51 is connected to the first circuit 41 in the housing 50. The second connection port 52 is connected to the second circuit 42 in the housing 50. The third connection port 53 is connected to the third circuit 43 in the housing 50. The fourth connection port 54 is connected to the fourth circuit 44 in the housing 50. The fifth connection port 55 is connected to the fifth circuit 45 in the housing 50. The first to fifth connection ports 51 to 55 are connected to the first to fifth drive units 2*a* to 2*e* via electric cables, respectively.

The first battery connection port 56 is connected to the first electric circuit 31 in the housing 50. The second battery connection port 57 is connected to the second electric circuit 32 in the housing 50. The first battery connection port 56 is connected to the first battery 21 via an electric cable. The second battery connection port 57 is connected to the second battery 22 via an electric cable.

The controller 38 transmits a signal to the first to fourth switches 33 to 36 to control the first to fourth switches 33 to 36. The controller 38 includes, for example, a computer that includes a processor and memory. The controller 38 controls the discharge and charge of the first battery 21 and the second battery 22 by controlling the first to fourth switches 33 to 36.

The controller 38 connects the first battery 21 to the first drive unit 2*a* and the fifth drive unit 2*e* by switching the first switch 33 to the closed state to supply the electric power to start the first drive unit 2*a* and the fifth drive unit 2*e* from the first battery 21 to the first drive unit 2*a* and the fifth drive unit 2*e*. The controller 38 connects the second battery 22 to the second to fourth drive units 2*b* to 2*d* by switching the second switch 34 and the third switch 35 to the closed state to supply the electric power to start the second to fourth drive units 2*b* to 2*d* from the second battery 22 to the second to fourth drive units 2*b* to 2*d*.

The ON signal from the start switch 17 is input to the remote controller 14. When the remote controller 14 receives the ON signal from the start switch 17, the remote controller 14 transmits a command signal to start the first to fifth drive units 2*a* to 2*e* to the first to fifth ECUs 9*a* to 9*e*. The remote controller 14 sequentially starts the first to fifth drive units 2*a* to 2*e* at different timings. The remote controller 14 transmits a command signal to start the first to fifth drive units 2*a* to 2*e* to the first to fifth ECUs 9*a* to 9*e* at different timings. Specifically, the remote controller 14 starts the first drive unit 2*a*, the fourth drive unit 2*d*, the second drive unit 2*b*, the fifth drive unit 2*e*, and the third drive unit 2*c* in this order. As a result, it is prevented that the first to fifth drive units 2*a* to 2*e* are started at the same time.

The power supply system 300 includes a first sensor 25 and a second sensor 26. The first sensor 25 is connected to the first battery 21. The first sensor 25 detects the voltage and current of the first battery 21 and transmits a signal indicating the voltage and current to the controller 38. The second sensor 26 is connected to the second battery 22. The second sensor 26 detects the voltage and current of the second battery 22, and transmits a signal indicating the voltage and current to the controller 38.

The controller 38 calculates a first remaining battery power that indicates a remaining electric power of the first battery 21 based on the signal from the first sensor 25. The controller 38 calculates a second remaining battery power that indicates a remaining electric power of the second battery 22 based on the signal from the second sensor 26. The first battery 21 and the second battery 22 are charged by the generators of the first to fifth marine propulsion devices 1*a* to 1*e*. The remaining battery powers are indicated by SOC (State Of Charge). SOC defines a fully charged state as 100% and a fully discharged state as 0%.

The controller 38 controls the discharge and charge of the first battery 21 according to the first remaining battery power. The controller 38 controls the discharge and charge of the second battery 22 according to the second remaining battery power. For example, the controller 38 stops the discharge of the first battery 21 when the first remaining battery power reaches a predetermined lower limit value, and charges the first battery 21 by the generators of the first to fifth marine propulsion devices 1*a* to 1*e*. When the second remaining battery power reaches a predetermined lower limit value, the controller 38 stops the discharge of the second battery 22, and charges the second battery 22 by the generators of the first to fifth marine propulsion devices 1*a* to 1*e*.

The controller 38 acquires the life of the first battery 21 and the life of the second battery 22. The controller 38 calculates the life of the first battery 21 from the first remaining battery power and the current and voltage of the first battery 21. The controller 38 calculates the life of the second battery 22 from the second remaining battery power and the current and voltage of the second battery 22. The controller 38 displays a warning on the display device 16 according to the life of the first battery 21 and the life of the second battery 22. For example, the warning is displayed on the display device 16 by a predetermined period before the life of the first battery 21 and the life of the second battery 22 reach the end of their lives. The warning includes text or images to draw attention to the operator.

The controller 38 calculates the discharge depth of the first battery 21 and the discharge depth of the second battery 22. The controller 38 controls the discharge and charge of the first battery 21 so that the discharge depth of the first battery 21 does not exceed the first threshold value. The controller 38 controls the discharge and charge of the second battery 22 so that the discharge depth of the second battery 22 does not exceed the second threshold value. The first threshold value is set to an appropriate value of the discharge depth so as not to excessively shorten the life of the first battery 21. The second threshold value is set to an appropriate value of the discharge depth so as not to excessively shorten the life of the second battery 22.

The controller 38 controls the first to fourth switches 33 to 36 according to the operation of the input device 15. The controller 38 receives the signal from the input device 15. The operator is able to manually switch between the closed state and the open state of the first to fourth switches 33 to 36 by operating the input device 15. For example, when an abnormality occurs in one of the first battery 21 and the second battery 22, the operator is able to switch the fourth switch 36 to the closed state by operating the input device 15. As a result, the first electric circuit 31 and the second electric circuit 32 are connected. As a result, even if one of the first battery 21 and the second battery 22 is abnormal, the first to fifth drive units 2*a* to 2*e* are able to be started by the other normal battery.

In the power supply systems 300 according to the preferred embodiments described above, the first drive unit 2*a* of the first marine propulsion device 1*a* is started by the electric power from the first battery 21. Further, the second drive unit 2*b* of the second marine propulsion device 1*b* and the third drive unit 2*c* of the third marine propulsion device 1*c* are started by the electric power from the second battery 22. Therefore, the second battery 22 is shared by the second drive unit 2*b* and the third drive unit 2*c*. Thus, the number of batteries is reduced while maintaining good startability of the drive units 2*a* to 2*e*.

Although preferred embodiments of the present invention have been described above, the present invention is not limited to the above-described preferred embodiments, and various modifications can be made without departing from the gist of the present invention.

The marine propulsion devices are not limited to outboard motors, but may be other propulsion devices such as a sterndrive or a jet propulsion device. The number of marine propulsion devices is not limited to five. The number of marine propulsion devices may be less than five or more than five. The number of batteries is not limited to two and may be more than two. The structures of the marine propulsion devices are not limited to that of the above-described preferred embodiments, and may be changed. For example, the drive unit is not limited to the internal combustion engine, and may be an electric motor. In that case, the drive unit may be driven by the electric power from the battery not only at the time of starting but also at the time of navigation after starting. The drive unit may be a hybrid system of an internal combustion engine and an electric motor. The drive unit may be directly connected to the propeller shaft without going through the drive shaft.

The order of starting the drive units by the start switch 17 is not limited to that of the above-described preferred embodiments, and may be changed. For example, the drive units may be started at the same time in the marine propulsion devices connected to the first battery 21 and the marine propulsion devices connected to the second battery 22. The configuration of the battery management device 23 is not limited to that of the above-described preferred embodiments, and may be changed. For example, the combination of the first to third switches 33 to 35 and the marine propulsion devices connected to them may be changed.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A power supply system for a watercraft including a first marine propulsion device including a first engine, a second marine propulsion device including a second engine, and a third marine propulsion device including a third engine, the power supply system comprising:

a first battery;

a second battery; and a battery management device configured or programmed to:

connect the first battery to the first engine to supply an electric power from the first battery to start the first engine; and connect the second battery to the second engine and the third engine to supply an electric power from the second battery to start the second engine and the third engine.

2. The power supply system according to claim 1, wherein the battery management device includes:

a first switch to switch between an electrical connection and a disconnection between the first engine and the first battery;

a second switch to switch between an electrical connection and a disconnection between the second engine and the second battery;

a third switch to switch between an electrical connection and a disconnection between the third engine and the second battery; and a controller configured or programmed to control the first switch, the second switch, and the third switch.

3. The power supply system according to claim 1, further comprising:

a start switch; wherein when the start switch is operated, the first marine propulsion device, the second marine propulsion device, and the third marine propulsion device sequentially start the second engine and the third engine at different timings.

4. The power supply system according to claim 1, further comprising:

a start switch; wherein when the start switch is operated, the first marine propulsion device, the second marine propulsion device, and the third marine propulsion device sequentially start the first engine, the second engine, and the third engine at different timings.

5. The power supply system according to claim 4, wherein the first marine propulsion device is located on a port side of the watercraft;

the third marine propulsion device is located on a starboard side of the watercraft;

the second marine propulsion device is located at a center of the watercraft between the first marine propulsion device and the second marine propulsion device; and when the start switch is operated, the first marine propulsion device, the second marine propulsion device, and the third marine propulsion device start the first engine, the second engine, and the third engine in this order.

6. The power supply system according to claim 1, wherein the battery management device includes:

a first electric circuit to connect the first battery to the first engine;

a second electric circuit to connect the second battery to the second engine and the third engine; and a fourth switch to switch between an electrical connection and a disconnection between the first electric circuit and the second electric circuit.

7. The power supply system according to claim 1, further comprising:

a display; wherein the battery management device is further configured or programmed to:

obtain a life of the first battery and a life of the second battery; and display a warning on the display according to the life of the first battery and the life of the second battery.

8. The power supply system according to claim 1, wherein the battery management device is further configured or programmed to control discharge and charge of the first battery so that a discharge depth of the first battery does not exceed a first threshold value.

9. The power supply system according to claim 1, wherein the battery management device is further configured or programmed to control discharge and charge of the second battery so that a discharge depth of the second battery does not exceed a second threshold value.

10. The power supply system according to claim 1, wherein the battery management device is further configured or programmed to:

obtain a remaining electric power of the first battery; and control discharge and charge of the first battery according to the remaining electric power of the first battery.

11. The power supply system according to claim 1, wherein the battery management device is further configured or programmed to:

obtain a remaining electric power of the second battery; and control discharge and charge of the second battery according to the remaining electric power of the second battery.

12. The power supply system according to claim 1, wherein the watercraft further includes a fourth marine propulsion device including a fourth engine; and the battery management device is further configured or programmed to connect the second battery to the fourth engine to supply an electric power from the second battery to start the fourth engine.

13. The power supply system according to claim 12, wherein the watercraft further includes a fifth marine propulsion device including a fifth engine; and the battery management device is further configured or programmed to connect the first battery to the fifth engine to supply an electric power from the first battery to start the fifth engine.

14. The power supply system according to claim 13, further comprising:

a start switch; wherein when the start switch is operated, the first marine propulsion device, the second marine propulsion device, the third marine propulsion device, the fourth marine propulsion device, and the fifth marine propulsion device sequentially start the first engine, the second engine, the third engine, the fourth engine, and the fifth engine at different timings.

15. The power supply system according to claim 14, wherein the first marine propulsion device is located on a port side of the watercraft;

the third marine propulsion device is located on a starboard side of the watercraft;

the second marine propulsion device is located at a center of the watercraft between the first marine propulsion device and the third marine propulsion device;

the fourth marine propulsion device is located between the first marine propulsion device and the second marine propulsion device;

the fifth marine propulsion device is located between the third marine propulsion device and the second marine propulsion device; and when the start switch is operated, the first marine propulsion device, the second marine propulsion device, the third marine propulsion device, the fourth marine propulsion device, and the fifth marine propulsion device start the first engine, the fourth engine, the second engine, the fifth engine, and the third engine in this order.

16. The power supply system according to claim 1, wherein the battery management device includes:

a housing;

a first connection port on the housing and connected to the first engine;

a second connection port on the housing and connected to the second engine;

a third connection port on the housing and connected to the third engine;

a first battery connection port on the housing and connected to the first battery; and a second battery connection port on the housing and connected to the second battery.

17. A watercraft comprising:

a hull;

a first marine propulsion device attached to the hull;

a second marine propulsion device attached to the hull;

a third marine propulsion device attached to the hull; and the power supply system according to claim 1 connected to the first marine propulsion device, the second marine propulsion device, and the third marine propulsion device.

18. A power supply system for a watercraft including a first marine propulsion device including a first drive, a second marine propulsion device including a second drive, and a third marine propulsion device including a third drive, the power supply system comprising:

a first battery;

a second battery; and a battery management device configured or programmed to:

connect the first battery to the first drive to supply an electric power from the first battery to start the first drive; and connect the second battery to the second drive and the third drive to supply an electric power from the second battery to start the second drive and the third drive.

* * * * *